US006397860B1

(12) United States Patent
Hill, II

(10) Patent No.: US 6,397,860 B1
(45) Date of Patent: Jun. 4, 2002

(54) DISPOSABLE PORTABLE WATERLESS TEETH-CLEANING ASSEMBLIES AND METHOD OF MANUFACTURE

(76) Inventor: Robert Charles Hill, II, 120 - 30th St. W., Bradenton, FL (US) 34205

( * ) Notice: Subject to any disclaimer, the term of this patent is extended or adjusted under 35 U.S.C. 154(b) by 0 days.

(21) Appl. No.: 09/718,933

(22) Filed: Nov. 21, 2000

(51) Int. Cl.[7] ..... A45D 44/18
(52) U.S. Cl. ..... 132/309; 206/369
(58) Field of Search ..... 132/308, 309, 132/310; 206/368, 369, 63.5, 570, 572, 362.3, 362.1, 362.2, 357

(56) References Cited

U.S. PATENT DOCUMENTS 2,649,958 A * 8/1953 Hallahan
4,588,089 A * 5/1986 Yanz, Jr. et al. ..... 206/63.5
4,880,111 A * 11/1989 Bagwell et al. ..... 206/362.2
4,972,946 A * 11/1990 Whittaker ..... 206/368
5,524,764 A * 6/1996 Kaufman et al. ..... 132/309
D391,399 S 3/1998 Mills
5,819,765 A * 10/1998 Mittiga ..... 132/309

* cited by examiner

*Primary Examiner*—Todd E. Manahan

(57) ABSTRACT

A disposable waterless tooth brushing assembly, and a method for its manufacture, comprising a diminutive toothbrush; a non-foaming saliva-activated teeth-cleaning agent pre-applied to the toothbrush bristles; a small moistened disposable towel for use after teeth cleaning; and a compact, lightweight, two-layer, heat-sealed packaging container for pre-use sanitary storage of the toothbrush and towel. For efficiency and reduced cost, several assemblies would be attached together during manufacture, and made readily separable for individual use. Applications can include, but are not limited to, storage in office desks for discrete and convenient waterless teeth cleaning without leaving the desk area, storage in the glove compartment of a motor vehicle for convenient waterless teeth cleaning and breath freshening in the vehicle without a mess, and storage in a purse, backpack, book bag, or briefcase for use by travelers, shoppers, students, and sports enthusiasts conscientious about teeth cleaning while away from home.

20 Claims, 1 Drawing Sheet

DISPOSABLE PORTABLE WATERLESS TEETH-CLEANING ASSEMBLIES AND METHOD OF MANUFACTURE

BACKGROUND—FIELD OF INVENTION

This invention relates to devices used for cleaning teeth, specifically to a disposable, easily portable, waterless teeth-cleaning assembly, and a method for its manufacture, comprising a diminutive toothbrush; a non-foaming saliva-activated teeth-cleaning agent and breath freshener, that is pre-applied and dried onto the toothbrush bristles; a folded and airtight sealed small moistened disposable towel for optional use after teeth cleaning; a flexible, thin-walled, airtight packaging container for sanitary storage of the toothbrush prior to use, with the packaging container being only slightly larger than the perimeter dimensions of the combined toothbrush and disposable towel package, with the front and back layers of the packaging container also being preferably heat sealed together between the toothbrush bristles and the disposable towel package to create two separated compartments within the packaging container so as to prevent contact between the disposable towel package and the pre-coated toothbrush bristles. For cost efficient manufacture and sale it is contemplated that several assemblies would be attached together during manufacture, and made readily separable from one another by a perforated or other easily separable connection for individual transport and use. Also, although the toothbrush in each packaging container could be reused multiple times, with or without newly applied dentifrice, it is contemplated for the entire assembly to be discarded after one use. Applications can include, but are not limited to, storage in a desk or cabinet for use by an office worker to conveniently clean his or her teeth after a meal without water and without having to leave the desk area, storage in the glove compartment of a motor vehicle for use by frequent business travelers or those on extended travel for pleasure to provide a convenient means for teeth cleaning and breath freshening after meals without the potential mess associated with performing such activity with the use of liquids in or around a motor vehicle, storage in a backpack or other type of school book bag for use by students not having adequate time between classes to stop in a restroom for teeth cleaning, storage in a backpack or equipment bag for waterless use by campers or hikers in areas where there is a limited availability of restroom facilities and potable water supplies, and storage in a purse or briefcase for use by any traveler conscientious about teeth cleaning and not having a conveniently available source of potable water available for the clean up necessary after teeth cleaning with the traditional foaming dentifrices and mouthwashes commonly used at home.

BACKGROUND—DESCRIPTION OF PRIOR ART

It is important for people to brush their teeth at least twice a day to freshen breath and lessen the risk of tooth decay. Although most people brush in the morning and/or at night, brushing in the middle of the day is also desirable, particularly after meals, as it further reduces a person's need for fillings and more complex dental procedures. However, many find that it is too time consuming and inconvenient for them to fit mid-day teeth cleaning into their schedules, even though they know it would be beneficial to do so. While away from home and relying on the use of prior art devices, mid-day tooth brushing has heretofore involved the transport of a toothbrush, optionally a toothbrush holder, and a separate container of toothpaste, powdered dentifrice, or mouthwash into an office, school, or other public restroom, and thereafter using a source of potable water to clean the user's mouth, toothbrush, and hands after the tooth brushing portion of the procedure is complete. Since the sinks in public restrooms often do not have adjacent countertops onto which one can securely and sanitarily place a toothbrush holder or a container of dentifrice while tooth brushing is being conducted, tooth brushing in public places has typically been a cumbersome, inconvenient, and time consuming ordeal. Although clothing pockets can be used to temporarily hold tooth brushing items, when pockets in career clothing are used, the items held should be thoroughly rinsed and wiped of excess water and residue prior to placement therein to avoid fabric damage, thus adding extra time to the tooth brushing process. Tooth brushing alternatives for a person traveling by automobile are often limited to use of a toothbrush and the application of a foaming paste or other type of foaming dentifrice in a public restroom at a restaurant, rest stop, or gas station, which can lack the minimum sanitary standard desired. In lieu of toothpaste, travelers can also carry with them a quantity of mouthwash for use in public restrooms along the highway to temporarily kill mouth germs until tooth brushing can later take place, or they can chew gum and/or eat breath mints after meals to freshen breath until a later tooth cleaning procedure with a toothbrush and foaming dentifrice can take place in a convenient and acceptably sanitary location. If tooth brushing with a foaming paste or gel and prior art apparatus were to take place at a desk or in a car, the procedure would be cumbersome, awkward, and have the potential of creating a mess. The user would have to supply a source of rinse water and a container for discarding both the rinse water and used dentifrice. If the toothbrush used was not intended to be disposable, the user would have to take into account and provide an amount of potable water for rinsing his or her mouth, as well as for rinsing the toothbrush. Folding toothbrushes, and those otherwise having enhanced portability, would make storage of tooth cleaning apparatus more convenient in a backpack, desk, or motor vehicle glove compartment, however, such devices would not lessen the time involved in accomplishing a tooth brushing procedure in a location remote from one's home, nor would they solve the problem associated with disposal of rinse water when teeth cleaning is attempted at a desk or in a car. The rinse water disposal problems and extra time typically associated with cleaning a toothbrush after use would be eliminated by the use of a disposable toothbrush. However, use of a disposable toothbrush alone would not solve the problem of how to dispose of the discarded rinse water used to eliminate foam residue on the mouth and hands, should one attempt to brush one's teeth at a desk or in a motor vehicle with a foaming paste, gel, or mouthwash product. The present invention solves all of the above-stated problems by making available to all travelers in a convenient, sanitary, lightweight, compact, inexpensive, durable, easy-to-transport, and easy-to-use packaging container, all of the resources needed for quick, easy, and neat waterless tooth brushing away from home. No invention is known to have all of the advantages of the present invention.

The invention thought to be the closest in concept to the present invention is disclosed in U.S. Pat. No. D391,399 to Mills (1998). Both the Mills invention and the present invention provide a toothbrush and a quantity of dentifrice to help a user remove food particles from teeth that otherwise would adhere to the them, form plaque, and ultimately cause tooth decay. However, the Mills invention and the present invention also have important differences. The Mills invention is depicted as a toothbrush kit having a box with at least one end that can be opened and re-closed. The box is shorter in length than the Mills toothbrush when it is in its usable extended condition, and has a rectangular cross-sectional configuration that further indicates manufacture from paper products. The Mills toothbrush kit also has a toothbrush with a folding handle, the distal end of which can be placed behind its proximal end, and when the two ends are positioned substantially parallel to one another, the Mills toothbrush is sufficiently shortened so that it can be placed fully within the box. The Mills toothbrush kit also comprises a small, flattened packet of dentifrice and a collapsible paper cup. The cup and packet also each have a perimeter dimension allowing for easy insertion into and removal from the box. In contrast, the present invention comprises a diminutive toothbrush and a small moistened disposable towel, both stored prior for use in a sanitary, sealed, airtight, thin-walled, flexible plastic packaging unit, easily separable for independent transport from the adjacent packaging unit or units to which it is attached. In the preferred embodiment, the upper surface of each packaging unit would be substantially transparent, with the exception of information needed for product identification and differentiation. Also, the toothbrushes used in the present invention would preferably have soft white bristles, and a clear handle made from either green or blue plastic material so that the present invention has a pleasing, clean-looking appearance to encourage use. In addition to the configuration of the toothbrush and the type of packing used, another significant difference between the Mills invention and the present invention is that the present invention is intended for waterless use, while the Mills invention is not. During manufacture of the present invention, a teeth-cleaning agent is applied to and dried onto the distal end of each toothbrush bristle used. As a result, approximately two-thirds to three-fourths of each toothbrush bristle becomes pre-coated with tooth-cleaning dentifrice. It is contemplated for the teeth-cleaning agent to be non-sticky, non-foaming, and saliva activated, thereby eliminating the need for a source of potable rinse water. It is also contemplated for the dried teeth-cleaning agent to be provided in both peppermint and wintergreen flavors, with the peppermint flavor associated with the toothbrushes having blue handles and the wintergreen flavor associated with toothbrushes having green handles. Also, although not limited thereto, the same liquid used as a medium for the non-sticky teeth-cleaning agent would preferably be used to dampen the disposable towel, so that there would be no unpleasant mixing of scents, and no potential risk of a non-edible product leaking from the disposable towel package into the pre-coated toothbrush bristle compartment of a unit packaging assembly. Further, although not limited thereto, the teeth-cleaning agent could comprise a non-foaming mouthwash type of product, or a product comprising or similar to a tooth polish, the selected product also comprising a breath freshener. Once a user has completed brushing his or her teeth with the present invention, a simple wipe of the mouth with the accompanying moistened disposable towel would neatly and conveniently conclude the tooth brushing process. Since no water would be required, people could easily clean their teeth at any time and in any location convenient to them. They would not have to seek out a source of potable water or a restroom for the discrete disposal of the rinse water used to eliminate a foam residue from in and around the mouth. Manufacture of the present invention to provide joined packaging units that are easily separable from one another would reduce unit cost, and make the present invention affordable by most travelers, particularly when one considers the ever-increasing cost of dental fillings and crowns, and their long-term impact on teeth. Tooth brushing with the present invention also saves time, over use of the Mills invention, since use of the Mills invention requires the time needed to secure a source of potable water, as well as the location of an appropriate means for disposal of any rinse water used. Both the Mills invention and the present invention require the use of a solid waste receptacle. In the Mills invention, the folded cup provided appears to be a single use, disposable paper cup that would not be easily dried or refolded for storage in the same paper box in which it was packaged prior to use. Although the Mills toothbrush and package of dentifrice could be discarded, if the dentifrice is not totally exhausted during its first use, it is likely that both would be reinserted into the box for subsequent use. In contrast, it is contemplated for the entire present invention to be discarded after a single use. Also, until a proper and convenient solid waste disposal container is found, the used disposable towel, opened disposable towel package, and the used toothbrush of the present invention can be temporarily housed within the original packaging unit, or a portion of it, whereby in the interim between use and disposal, any residual teeth-cleaning agent on the toothbrush or disposable towel would be prevented from having contact with any other object. No device or method is known for waterless tooth cleaning purposes that has all of the advantages offered by the present invention.

SUMMARY OF INVENTION—OBJECTS AND ADVANTAGES

The primary object of this invention is to provide a disposable, waterless tooth brushing assembly that can be discretely and conveniently used to remove food particles from teeth after a meal in a location where the person using it does not have ready access to a source of potable rinse water, or a container or facility for the convenient and discrete discard of used rinse water. It is also an object of this invention to provide a waterless tooth brushing assembly with components that are compact in configuration and lightweight for easy transport. A further object of this invention is to provide a waterless tooth brushing assembly in which the toothbrush is immediately available to a user for prompt tooth cleaning use. It is also an object of this invention to provide a waterless tooth brushing assembly that is fast and simple to use. It is a further object of this invention to provide a waterless tooth brushing assembly that is cost effective to manufacture and use. A further object of this invention is to provide a waterless tooth brushing assembly that comprises a toothbrush maintained in a sanitary condition prior to use. It is also an object of this invention to provide a waterless tooth brushing method that contemplates use of a teeth-cleaning agent that is non-sticky, pleasant in flavor, and non-foaming so that a rinsing step is not required. A further object of this invention is to provide a teeth-cleaning agent that also can be used to freshen breath. It is also an object of this invention to provide a waterless tooth brushing assembly in which the components can indefinitely remain in a substantially self-contained condition after use until a convenient means for solid waste disposal can be found for their discard.

As described herein, properly manufactured and used, the present invention provides a waterless tooth brushing assembly that would allow discrete and convenient use to remove food particles from teeth after a meal at an office desk, in a motor vehicle, or in any other location where the person using it does not have ready access to a source of potable rinse water, or a container for convenient discard of used rinse water. It is fast, simple, and convenient to use, since the toothbrush is initially sealed in an easily opened sanitary container. Also, its toothbrush bristles are pre-coated with a teeth-cleaning agent that is dried thereon, saliva-activated, and available for immediate use. Further, since the teeth-cleaning agent is non-sticky and non-foaming, clean up after brushing one's teeth at a maximum would involve the use of an accompanying pre-moistened disposable towel to freshen the hands and the area immediately around the mouth, but usually only the area around the mouth. The present invention is safe to use, as its toothbrush would contain soft bristles that are maintained in a sanitary condition prior to use. Preferably, and when the teeth-cleaning agent and disposable towel moistening agent comprise different compositions, the bristle end of the toothbrush would be stored in a compartment separated from the small pre-moistened disposable towel to keep the disposable towel package from contact with the pre-applied teeth-cleaning agent on the bristles, as well as prevent interaction between the disposable towel moistening agent and the bristles if the integrity of a disposable towel package and/or unit packaging were to become inadvertently breached during transport or storage so as to allow moistening agent movement within a packaging unit. The toothbrush of the present invention is diminutive and lightweight, and the packaging unit used to house both the toothbrush and disposable towel is thin-walled, made from lightweight materials, and compact, thus allowing for convenient and efficient storage and transport prior to use. Further, since it is contemplated for the present invention to be manufactured with easily separable, initially joined, multiple packaging units, the per unit manufacturing cost would be kept low so that the present invention is cost effective to manufacture and use. Although not limited thereto, it is contemplated that at least four packaging units would be combined during manufacture for distribution purposes, with a toothbrush and pre-moistened disposable towel heat sealed into each individual packaging unit. If four packaging units were to be assembled at once, four sealed pre-moistened disposable towel packages would be spaced apart from one another and laid upon the units' combined bottom packaging layer. Four toothbrushes would also be placed on the combined bottom packaging layer, with the non-bristle end of each positioned upon a different one of the disposable towel packages. The units' combined top packaging layer would then be spread over all four toothbrushes and the combined bottom packaging layer, aligned with the bottom packaging layer, and after alignment the perimeter edges of both layers would be heat sealed together to create four airtight packaging units joined together in a manner providing a series of ridges, perforations, or other means or combination of means allowing easy separation therebetween, as well as easy opening by a user. Although not limited thereto, it is preferred that the heat-sealing process used for joining perimeter edges would also simultaneously create two compartments within each packaging unit, one for the pre-coated toothbrush bristles and the other for the opposing end of the toothbrush and the disposable towel package. The two layers used to form the joined packaging units would be made from a flexible thin-walled but durable material, sealed airtight to provide extended sanitary storage for the toothbrush bristles. In addition to being not easily punctured, but easily opened upon demand, the material used for each packaging unit would also maintain its integrity after opening, not easily being ripped or shredded into multiple pieces, so that the packaging unit can remain in tact for a sufficient period after toothbrush use for temporarily containing the used toothbrush and/or the used disposable towel until an appropriate waste disposal container is found for their discard. The present invention toothbrush would have a clean, fresh appearance to encourage its use, with white bristles and clear handles that are color-coded green or blue to visually indicate the flavor of teeth-cleaning agent pre-coating the bristles. The teeth-cleaning agent would also contain pleasant, breath freshening wintergreen or peppermint flavors, with the wintergreen flavor being applied to the toothbrushes having green handles and the peppermint flavor being applied to the toothbrushes having the blue handles. Also, to prevent unpleasant mixing of flavors and/or aromas, the disposable towel's moistening agent would preferably contain the same liquid medium used in the teeth-cleaning agent applied to the toothbrush bristles, although it is also considered to be within the scope of the present invention for the disposable towel's moistening agent and the teeth-cleaning agent to comprise different liquid media.

The description herein provides the preferred embodiments of the present invention but should not be construed as limiting the scope of the waterless tooth brushing assembly disclosed herein. For example, variations can occur in the number of bristles attached to each toothbrush handle; the length of each toothbrush bristle; the dimensions and/or perimeter configuration of the package used to contain the small pre-moistened disposable towel; the thickness of the packaging unit material used to house both the disposable towel and the toothbrush; the composition of package materials used for the disposable towel to keep it moistened and sanitary until use; the configuration of the perforation or other means used to facilitate separation between adjacent packaging units; the configuration of the means used to facilitate the opening of each packaging unit by a user; and the positioning of the heat sealed compartment divider within the packaging unit when one is used for separation of the disposable towel from the toothbrush bristles during pre-use storage, and obvious variations other than those shown and described herein, may also be incorporated into the present invention. Thus, the scope of the present invention should be determined by the appended claims and their legal equivalents, rather than the examples given.

DETAILED DESCRIPTION OF PREFERRED EMBODIMENTS

The concept behind the present invention is to have a small, disposable, easily stored, and easily transported disposable toothbrush that is convenient in size, rapid and neat to use, as well as aesthetically pleasing and user friendly, so as to encourage use by those who would like to brush their teeth while away from home and in situation where normal tooth brushing is not practical due to limited or no access to public supplies of potable water and/or no appropriate waste receptacle for disposal of used rinse water. Use of the present invention would not require rinse water. Also, the teeth-cleaning agent used, that would also freshen breath, would be pre-applied to the toothbrush bristles and dried onto them. The teeth-cleaning agent would be non-sticky and non-foaming, and there would be no dentifrice application step. As a result, use of the present invention toothbrush is immediate, once the packaging unit is opened, and the tooth cleaning process can be rapidly concluded without a mess. The toothbrushes of the preferred embodiment would each be sealed into an individual packaging unit for sanitary storage prior to use, with several packaging units being joined together during manufacture to help make the present invention cost effective to manufacture and use. A compactly folded and airtight sealed pre-moistened disposable towel would also be provided in each packaging unit, should the person using the toothbrush after a meal need to freshen the outside of his or her mouth after tooth cleaning. The packaging units would be configured and made from materials that generally maintain their integrity after opening, so that at least the portion of each packaging unit containing the disposable towel and toothbrush handle can be employed to neatly contain the toothbrush bristles and the moistened disposable towel after use, until a convenient waste disposal container can be found for their discard.

Figure 3:
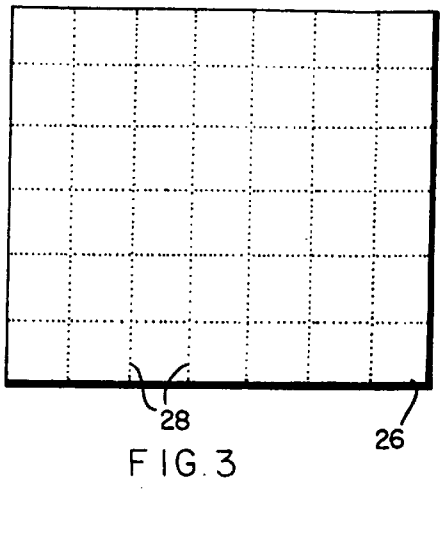
FIG. 3 is a top view of a disposable towel of the first preferred embodiment, unfolded and ready for use.
Figure 1:
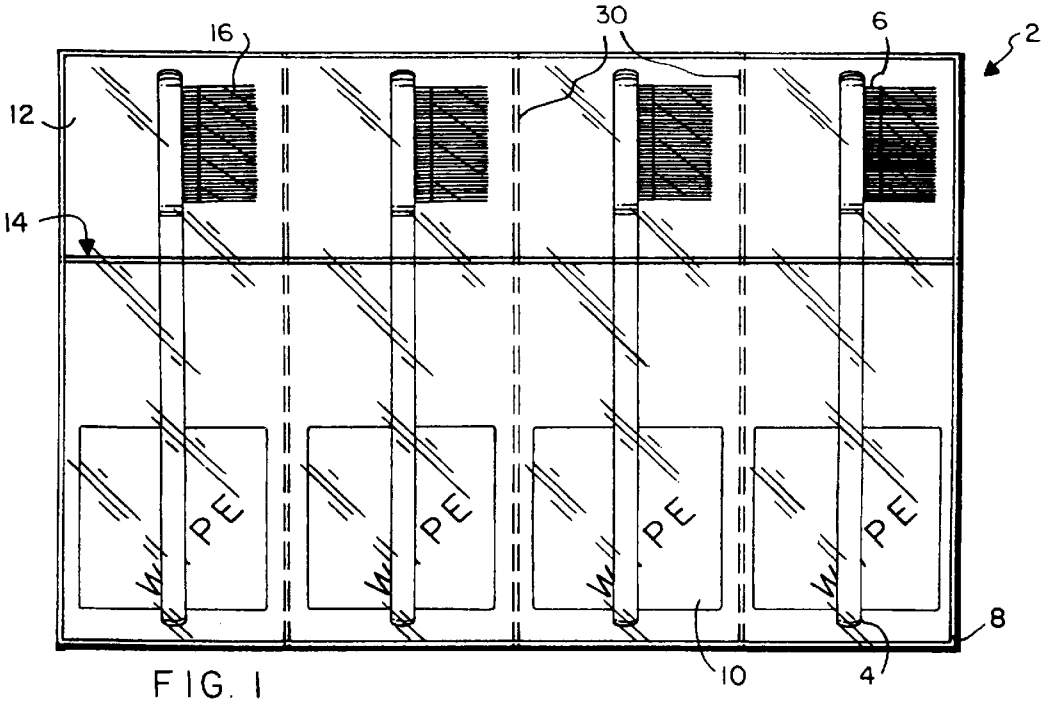
FIG. 1 is a top view of the first preferred embodiment of the present invention having four sealed packaging units made so as to be easily separable from one another, with each packaging unit having a toothbrush and one pre-moistened compactly-folded disposable towel, with the pre-coated toothbrush bristles being in a compartment separated from the disposable towel, with the packaging units, toothbrushes, and disposable towel packages in the illustration being only slightly smaller than actual size.
Figure 4:
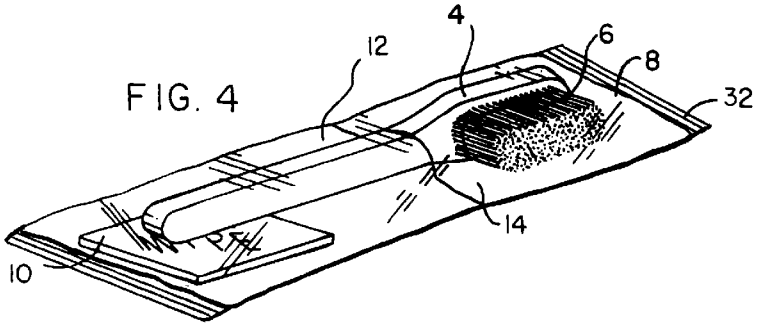
FIG. 4 is a perspective view of a separated packaging unit of a second preferred embodiment, housing a toothbrush and one compactly folded disposable towel, with the pre-coated toothbrush bristles being in a compartment separated from the disposable towel, and having heat sealed ends with laterally extending ridges.

FIG. 1 shows a first preferred embodiment of the present invention slightly smaller than actual size and having four toothbrushes 4 each placed into an individual packaging unit 8, with each of the individual packing units 8 joined to at least one other packaging unit 8. A perforated connection 30 is provided between adjacent packaging units 8. In the present invention the configuration and width of each perforated connection 30 is not critical, as long as it allows for easy separation of each packaging unit 8 from the next adjacent packaging units 8. Additionally, a plurality of ridges, similar to the ridges 32 shown in FIG. 4, could be used adjacent to perforated connection 30, oriented either parallel or perpendicular to it, for reinforcement of the side edges of each packaging unit 8 and to help maintain the airtight seal between adjacent packaging units 8 when one becomes separated from the other for individual use. A plurality of transverse or longitudinally extending ridges 32 could also be formed in the plastic material forming packaging units 8, so that they would extend beyond the ends of each packaging unit 8, similar to that shown in FIG. 4. The ridges 32 could be formed when the ends of packaging units 8 are heat sealed together, or in the alternative, as is FIG. 1, the ends can be heat sealed without a series of ridges 32. Although FIG. 1 shows four packaging units 8 connected together, the present invention is not limited thereto, and it is also considered to be within the scope of the present invention to have more than four, or less than four, packaging units 8 connected to one another during manufacture. The number of packaging units 8 combined during manufacture would depend in part upon customer preference and the need for cost efficient manufacture. FIG. 1 also shows each packaging unit 8 containing a wipe package 10 used for protection and airtight sealing of a small, compactly folded pre-moistened disposable towel, shown in FIG. 3 by the number 26 in its unfolded configuration. Each wipe package 10 is positioned between a toothbrush 4 and the bottom inside surface of the respective packaging unit 8 within which the toothbrush 4 has been placed. FIG. 1 further shows each individual packaging unit 8 to be substantially identical in size and configuration to the other packaging units 8 to which it is initially connected, and each individual packaging unit 8 having a perimeter dimension only slightly larger than the width of wipe package 10 and the length of the toothbrush 4 housed therein. Although it would be preferred for the size of packaging units 8 relative to the perimeter dimensions of wipe package 10 and toothbrush 4 housed therein to be minimally sufficient for containing them, for efficient transport and storage, manufacturing considerations may dictate slightly larger perimeter dimensions for one or more of the adjoining packaging units 8. FIG. 1 also shows each toothbrush 4 having bristles 6 longitudinally along approximately one-fourth of its length, near to one of its ends, and only on one side of its handle. Although not limited thereto, it is contemplated for all bristles 6 to be white in color, soft, and pre-coated on their distal ends with a teeth-cleaning agent 16. Preferably, teeth-cleaning agent 16 would comprise a light abrasive, and could also contain fluoride. It is contemplated at a minimum for at least one-half of the length of each bristle to be coated with teeth-cleaning agent 16. Also, although FIG. 1 shows bristles 6 on each toothbrush 4 facing to the right inside surface of its respective packaging unit 8, such orientation is not critical to the present invention and it is equally contemplated for bristles 6 on each toothbrush 4 to face the left inside surface of its respective packaging unit 8. The height limitations imposed by packaging units 8 to achieve compact transport and storage, would generally prevent toothbrushes 4 from being positioned within packaging units 8 with their bristles 6 extending in an upwardly direction. FIG. 1 further shows top packaging layer 12 extending over the top of all four packaging units 8, and a compartment divider 14 separating each wipe package 10 from the bristles 6 of the toothbrush 4 housed within the same packaging unit 8. The use of compartment divider 14 is not critical, but preferred, particularly if the moistening agent (not shown) for disposable towel 26, shown in FIG. 3, comprises a different liquid medium than the teeth-cleaning agent 16 dried onto bristles 6. As shown in FIG. 4, it is contemplated for compartment divider 14 to be formed through heat sealing of top packaging layer 12 to the combined bottom of packaging layer of adjacent packaging units 8, which would be accomplished simultaneously with the fusing together of the side edges of each packaging unit 8 to form airtight seals around the respective wipe packages 10 and toothbrush bristles 6.

It is contemplated that the present invention toothbrushes 4 would have a clean, fresh appearance to encourage use, preferably with white bristles 6 and clear handles that are color-coded green or blue to provide a visual aid to a user in identifying the flavor of teeth-cleaning agent 16 pre-coating bristles 6. The teeth-cleaning agent 16 would also preferably contain pleasant, breath freshening wintergreen or peppermint flavors, with the wintergreen flavor being applied to the toothbrushes 4 having green handles and the peppermint flavor being applied to the toothbrushes 4 having the blue handles. Also, to prevent unpleasant mixing of flavors and/or aromas, the disposable towel's 26 moistening agent (not shown) would preferably contain the same liquid medium used for teeth-cleaning agent 16. Further, it is contemplated for the amount of moistening agent added to disposable towels 26 to be sufficient for comfortably wiping the mouth area of a user (not shown) without undue abrasion or irritation. However, the amount of moistening agent added to each disposable towel 26 would not saturate it to the point of dripping, so that each disposable towel 26 would remain neat and tidy to use. Use of one or more chemicals, such as alcohol, to encourage rapid moistening agent evaporation is also considered to be within the scope of the present invention. Further, although not limited thereto, in the most preferred embodiment of the present invention it is contemplated for toothbrush 4 to have an overall length dimension of approximately three-and-three-fourths inches. The bristles 6 attached to each toothbrush 4 would be soft and approximately one-half inch in length. Bristles 6 would also extend longitudinally along toothbrush 4, near to one of its ends, for a distance of approximately three-fourths of an inch. Also preferably, approximately the distal two-thirds to three-fourths of bristles 6 would be pre-coated with teeth-cleaning agent 16. In its extended, unfolded configuration, as shown in FIG. 3, each disposable towel 26 would, in the alternative, preferably have length and width dimensions respectively of approximately eight and six inches, or perhaps a square perimeter dimension having sides each with a length dimension of approximately seven inches. Further, each wipe package 10 would preferably have a perimeter dimension less than two inches square, and a thickness dimension less than three-fourths of an inch. Three rows of bristles 6 are also contemplated and preferred, although not clearly shown in FIGS. 1, 2, and 4. In addition, although soft nylon bristles 6 are also preferred, the material from which bristles 6 are made is not critical, and it is also contemplated for bristles 6 to be made from polypropylene and polyester, as well as other materials that allow bristles 6 to be soft so that repeated use of the present invention toothbrushes 4 does not pose an injury risk to gum tissue (not shown).

Use of the present invention is fast, simple, and convenient, since each toothbrush 4 is sealed in an easily opened sanitary packaging unit 8 prior to use. Also, it is contemplated for bristles 6 to be pre-coated with a teeth-cleaning agent 16 that is dried thereon, saliva-activated, and available for immediate use once packaging unit 8 is opened. Further, since teeth-cleaning agent 16 is non-sticky and non-foaming, clean up after brushing one's teeth simply involves the optional use of an accompanying pre-moistened disposable towel 26 to freshen the user's hands and/or the area immediately around the user's mouth. The present invention would be safe to use, as each toothbrush 4 contains soft bristles 6 and is stored prior to use in a sanitary airtight sealed packaging unit 8. The bristle 6 end of each toothbrush 4 in the present invention would also be stored in a compartment separated from the disposable towel 26 with which it is housed, to keep wipe package 10 from contact with pre-applied teeth-cleaning agent 16 on bristles 6 during transport and storage, as well as to prevent interaction between the liquid medium used as a moistening agent on disposable towel 26 and the teeth-cleaning agent 16 on bristles 6 should the integrity of wipe package 10 and/or packaging unit 8 become compromised during transport or storage and allow movement of the moistening agent into the compartment of packaging unit 8 housing bristles 6. The toothbrush 4 of the present invention is diminutive and lightweight, and the packaging unit 8 for combined storage of toothbrush 4 and the disposable towel 26 is compact, thus allowing for convenient and efficient storage and transport prior to use. Toothbrush 4 is also easily held by an adult hand, shown in FIG. 2 by the number 18, to provide the minimal leverage necessary to create an amount of bristle 6 contact with teeth (not shown) to efficiently clean them. Further, since it is contemplated for the present invention to be manufactured and sold in multiple packaging units 8 that are easily separable from one another, manufacturing cost would be kept low so that the present invention is cost effective to both manufacture and use. Preferably, multiples of at least four packaging units 8 would be combined for distribution purposes, with one toothbrush 4 and one pre-moistened disposable towel 26 heat sealed into each adjoining individual packaging unit 8. When four packing units 8 are to be assembled at once, four wipe packages 10 would be spaced apart from one another and laid upon the units' combined bottom packaging layer. Four toothbrushes 4 would also be placed on the units' combined bottom packaging layer, each with their non-bristle ends upon a different one of the wipe packages 10. The units' combined top packaging layer 12 would then be spread over all four toothbrushes 4 and the combined bottom packaging layer of packaging units 8, after which the edges of both the top and bottom layers of packaging units 8 would be heat sealed to create four individual airtight packaging units 8 joined together in a manner providing ridges, perforations, or other means or combination of means allowing for easy separation therebetween, as well as easy opening by a person (not shown) wanting to use toothbrush 4 or disposable towel 26. The heat-sealing process could also simultaneously create two compartments within each packaging unit 8 when desired, one for the toothbrush bristles 6 and the other for the handle of toothbrush 4 and wipe package 10. The flexible two layers used to form the joined packaging units 8 would be made from a thin-walled but durable material, such as plastic, sealed airtight to provide extended sanitary storage for toothbrushes 4. Also, a substantial portion of top packaging layer 12 would remain transparent, limited only by the information necessary for product identification, so that a purchaser can visibly select the flavor of teeth-cleaning agent 16 desired by the blue or green color of the toothbrushes 4 within packaging units 8. The amount and type of information provided on the bottom layer of packaging units 8 is not critical, and it can be opaque, if desired. In addition to being easily opened upon demand, the material used for each packaging unit 8 would also maintain its integrity after opening, not easily being ripped or shredded into multiple pieces, so that at least the lower portion of packaging unit 8 can remain in tact and available for a sufficient period after toothbrush 4 use for temporarily containing the used bristle 6 end of toothbrush 4 and one used disposable towel 26 until an appropriate waste disposal container (not shown) is found for their discard. It is contemplated that packaging units 8 would comprise an easy 'tear open' type of configuration instead of a 'burst open' type of construction where opposite forces are applied to opposing sides of a package until a sealed end adjacent thereto suddenly opens. Although not shown, a plurality of longitudinally extending ridges, similar to the laterally extending ridges 32 shown in FIG. 4, could be formed in the ends of each packaging unit 8 and provide a means by which a user could easily gain access to the contents of packaging unit 8. A twisting type of motion applied to any two adjacent longitudinally extending ridges 32 should promptly allow the thin-walled packaging material between ridges 32 to separate and create access to toothbrush 4 and/or wipe package 10. If longitudinally extending ridges 32 positioned laterally on the ends of packaging units 8 are used for such interior access, the integrity of packaging unit 8 would more likely be preserved for use in temporarily housing used toothbrush 4 and used disposable towel 26 until an appropriate waste container (not shown) can be found for their discard. In the alternative, although not shown, a cut or notch could be formed in the heat sealed portion of packaging units 8for use in initiating the opening process.

Figure 2:
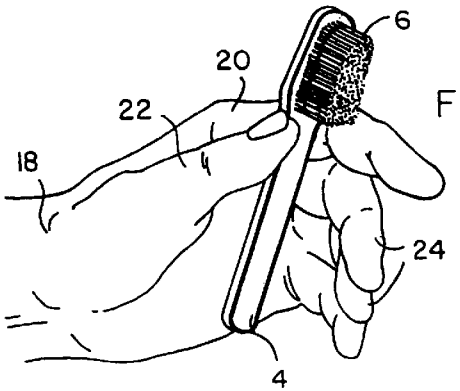
FIG. 2 is perspective view of the toothbrush of the first preferred embodiment held by a hand and showing the approximate size of the toothbrush relative to the hand.

FIG. 2 shows a human hand 18 holding the first preferred embodiment of toothbrush 4 between thumb 22 and the lower part of index finger 20. Bristles 6 remain above index finger 20 with the opposite end of toothbrush 4 being positioned adjacent to the three remaining fingers 24 of hand 18. Although not limited thereto, bristles 6 are shown in FIG. 2 to extend longitudinally on toothbrush 4, along approximately one-fourth of its total length. Although not clearly shown in FIG. 2, it is preferred to have three rows of bristles 6 on toothbrush 4, made from soft material, such as nylon. Also, white is the preferred color for bristles 6. Toothbrush 4 is shown to be diminutive in size relative to hand 18. However, toothbrush 4 retains sufficient length for easy gripping by thumb 22, index finger 20, and remaining fingers 24, to provide the leverage needed for bristles 6 to contact the teeth of a user (not shown) and effectively remove food particles and plaque. Also, although not clearly shown in FIG. 2, in the most preferred embodiment the handles of toothbrushes 4 would be clear, and blue or green in color, to provide a neat and aesthetically appealing appearance, as well as for corresponding to the peppermint or wintergreen flavor of the teeth-cleaning agent 16 applied to the distal ends of bristles 6, as shown in FIG. 1.

FIG. 3 shows an unfolded disposable towel 26 having multiple fold lines 28 and illustrates a preferred manner of folding disposable towel 26 that allows it to be compactly stored within a wipe package 10. It is contemplated for each disposable towel 26 to be made from a soft, absorbent, tear-resistant material. Although not shown, it is contemplated for a moistening agent to be applied to each disposable towel 26, before it is sealed within a wipe package 10. In the most preferred embodiment, disposable towel 26 would be saturated with moistening agent (not shown) to facilitate its use, but not supersaturated so as to cause the moistening agent to drip from disposable towel 26 and become messy during use. The construction and materials used for wipe package 10 are not critical, as long as they are sufficient to maintain disposable towel 26 in a sanitary condition prior to use, and also prevent premature evaporation of the moistening agent applied to each disposable towel 26. Although not limited thereto, each wipe package 10 could contain a foil or plastic layer to prevent such evaporation of the moistening agent (not shown) applied to disposable towels 26. Although not shown, to prevent an unpleasant mixing of aromas, in the preferred embodiment of the present invention the scent and/or flavor of the moistening agent applied to disposable towels 26 would be the same as the liquid medium used for the teeth-cleaning agent 16 applied to, and dried upon, toothbrush bristles 6. For example, should a wintergreen flavor be used for teeth-cleaning agent 16, the liquid medium applied to disposable towel 26 would also preferably comprise a wintergreen flavor and/or scent.

FIG. 4 shows a separated packaging unit 8 for a second preferred embodiment of the present invention containing a toothbrush 4 having bristles 6 near to one of its ends, longitudinally positioned along approximately one-fourth of its length. Although not clearly shown in FIG. 4, it is contemplated for bristles 6 to be white in color, soft, and pre-coated on their distal ends with a teeth-cleaning agent, indicated in FIG. 1 by the number 16. A sealed wipe package 10 configured to hold a small folded moistened disposable towel 26 is positioned between toothbrush 4 and the bottom inside surface of packaging unit 8. A compartment divider 14 is shown extending between cover 12 and the bottom inside surface of packaging unit 8. Compartment divider 14 separates wipe package 10 from bristles 6 so that wipe package 10 cannot come contact bristles 6 during transport or storage. When a compartment divider 14 is used, it is contemplated that compartment divider 14 would be formed at the same time top packaging layer 12 is heat sealed to the bottom layer of packaging unit 8. Although FIG. 4 shows bristles 6 facing to the right inside surface of packaging unit 8, such orientation is not critical and it is equally contemplated for bristles 6 to face the left inside surface of packaging unit 8. FIG. 4 also shows the ends of packaging unit 8 having laterally extending ridges 32 that would preferably be formed when cover 12 is sealed to the bottom layer of packaging unit 8. Although not shown, it is equally contemplated for ridges 32 to be longitudinally extending, when preferred to provide assistance in opening packaging unit 8. Further, since it is contemplated for packaging unit 8 to be a 'tear open' container, and not a 'burst open' container where opening would occur as a result of cover 12 and the bottom layer of packaging unit 8 being pulled in diametrically opposed directions, the ridges 32 could be used to facilitate opening of packaging unit 8, or in the alternative, although not shown, a cut or notch could be formed within the portion of packaging unit 8 containing ridges 32 to assist a user in gaining access to toothbrush 4 and wipe package 10 without the need for a pair of scissors, knife, or other tool (not shown). Also, although not shown, other embodiments could comprise packaging units 8 with a plurality of side ridges 32 extending either longitudinally or transversely adjacent to perforated connections 30 on one or more of the opposing side edges of both cover 12 and the bottom layer of packaging units 8. Such ridges adjacent to perforated connections 30 could help to reinforce the airtight sealing of packaging units 8 during the separation of adjacent packaging units 8 for individual use. Although not shown in FIG. 4, it is contemplated for product information to be placed upon cover 12. However, any product information used should not completely conceal the color of toothbrushes 4 so that a user can readily distinguish the identity of the flavoring used for the teeth-cleaning agent 16 on the toothbrushes 4 within packaging units 8, simply by viewing the color of the handles on toothbrushes 4 through cover 12. In addition, packaging units 8 would be made from puncture resistant material, that is flexible, thin-walled, mostly transparent, and low in cost.

What is claimed is:

1. A disposable teeth-cleaning assembly for prompt, discrete, and convenient brushing of teeth in locations where access to potable water and means for disposal of waste water are limited, said assembly comprising:

a diminutive toothbrush having opposite ends, a length dimension, and a quantity of soft bristles near to one of said opposite ends;

a quantity of non-foaming, saliva-activated teeth-cleaning agent applied to and dried upon said bristles;

a small disposable towel;

a quantity of moistening agent applied to said disposable towel, said quantity being less than the amount of said moistening agent needed to supersaturate said disposable towel;

a package adapted for airtight sealing of said disposable towel when said disposable towel is in a compactly folded configuration, said package having a width dimension; and a flexible, thin-walled, airtight packaging unit adapted for sanitary storage of said toothbrush and said disposable towel prior to use, said packaging unit being only slightly longer than said length dimension of said toothbrush and only slightly wider than said width dimension of said package, said packaging unit having a front member and a back member each having a perimeter edge, with said perimeter edges of said front member and said back member being heat sealed together.

2. The assembly of claim 1 wherein said front member and said back member are also heat sealed together laterally so that when said toothbrush and said package are positioned within said packaging unit two separated compartments are created to keep said package from coming into contact with said agent coated bristles during storage and transport.

3. The assembly of claim 1 wherein said teeth-cleaning agent is selected from a group consisting of non-foaming dentifrices, tooth polish, and non-foaming mouthwash.

4. The assembly of claim 1 wherein said teeth-cleaning agent and said moistening agent comprise at least one identical liquid medium and said liquid medium is selected from a group consisting of wintergreen flavored liquids, wintergreen scented liquids, peppermint flavored liquids, and peppermint scented liquids.

5. The assembly of claim 1 wherein said bristles are white in color and said toothbrush is selected from a group consisting of green toothbrushes and blue toothbrushes.

6. The assembly of claim 1 wherein said bristles have a length dimension of approximately one-half inch, said toothbrush has a maximum length dimension of approximately four inches, and said package has maximum length and width perimeter dimensions of approximately two inches.

7. A disposable teeth-cleaning assembly for prompt, discrete, and convenient brushing of teeth in locations where access to potable water and means for disposal of waste water are limited, said assembly comprising:

a plurality of diminutive toothbrushes each having opposite ends, a length dimension, and a quantity of soft bristles near to one of said opposite ends;

a quantity of non-foaming, saliva-activated teeth-cleaning agent applied to and dried upon said bristles;

a plurality of small moistened disposable towels;

a quantity of moistening agent applied to each of said disposable towels;

a plurality of packages adapted for airtight sealing of one of said disposable towels when said disposable towel is in a compactly folded configuration, said packages each having a width dimension; and a plurality of flexible, thin-walled, airtight packaging units each adapted for sanitary storage of one of said toothbrushes and one of said disposable towels prior to use, said packaging unit being only slightly longer than said length dimension of one said toothbrush and only slightly wider than said width dimension of one said package, each said packaging unit having a front member and a back member, with each said front member and each said back member having a perimeter edge, said perimeter edges of each said front member being heat sealed together with a different one of said back members to form one said packaging unit, and at least two of said packaging units being joined together by easily separable attachment means so that each said packaging unit may be promptly and neatly separated from the others for individual use.

8. The assembly of claim 7 wherein said front member and said back member in each said packaging unit are further heat sealed together laterally so that when one of said toothbrushes and one of said packages are positioned therein, two separated compartments are created to keep said package from coming into contact with said agent coated bristles during storage and transport.

9. The assembly of claim 7 wherein said teeth-cleaning agent is selected from a group consisting of non-foaming dentifrices, tooth polish, and non-foaming mouthwash.

10. The assembly of claim 7 wherein said teeth-cleaning agent and said moistening agent comprise at least one identical liquid medium and said liquid medium is selected from a group consisting of wintergreen flavored liquids, wintergreen scented liquids, peppermint flavored liquids, and peppermint scented liquids.

11. The assembly of claim 7 wherein said bristles are white in color and said toothbrushes are selected from a group consisting of green toothbrushes and blue toothbrushes.

12. The assembly of claim 7 wherein said bristles have a length dimension of approximately one-half inch, said toothbrushes each have a maximum length dimension of approximately four inches, and said packages each have a maximum length and width perimeter dimension of approximately two inches.

13. The assembly of claim 7 wherein said separable attachment means is selected from a group consisting of perforated attachment means and ridged attachment means.

14. A method for manufacturing a waterless, disposable teeth-cleaning assembly, said method comprising the steps of:

providing a plurality of diminutive toothbrushes each having bristles near to one end, a quantity of non-foaming, saliva-activated teeth-cleaning agent; a number of small disposable towels identical to the number of toothbrushes; a quantity of moistening agent, a number of packages identical to the number of disposable towels, a plurality of sanitary flexible thin-walled lower packaging unit members, and a number of sanitary flexible thin-walled upper packaging unit members identical to the number of lower packaging unit members;

sanitarily applying said teeth-cleaning agent to said bristles;

allowing said teeth-cleaning agent to dry upon said bristles;

sanitarily applying said moistening agent to each of said disposable towels so that said disposable towels each become moistened, but not supersaturated, with said moistening agent;

folding each of said moistened disposable towels into a compact configuration;

sealing each of said moistened disposable towels into one of said small disposable packages so that evaporation of said moistening agent is prevented prior to use;

horizontally extending one of said lower packaging members;

placing a plurality of said sealed packages onto said horizontally extended lower packaging member at spaced apart distances from one another;

placing one of said toothbrushes on top of each of said spaced apart sealed packages;

horizontally extending one of said upper packaging members over said toothbrushes and said spaced apart sealed packages, while at the same time aligning said horizontally extending upper packaging member with said horizontally extended lower packaging member;

heat sealing perimeter edges of said horizontally extended upper packaging member to said horizontally extended lower packaging member; and creating easily separable means in said horizontally extended upper packaging member and said horizontally extended lower packaging member between said spaced apart packages so that individual ones of said toothbrushes can be promptly and neatly separated from the remaining ones of said toothbrushes on said horizontally extended lower packaging member for independent transport, storage and use without disturbing the remainder of said horizontally extended upper packaging member and said horizontally extended lower packaging member sanitarily heat sealed around the remaining ones of said spaced apart toothbrushes and said spaced apart packages.

15. The method of claim 14 also comprising a step of heat sealing said horizontally extended upper packaging member to said horizontally extended lower packaging member transversely so as to create a separated compartment for said bristles.

16. The method of claim 15 wherein said step of heat sealing perimeter edges of said horizontally extended upper packaging member to said horizontally extended lower packaging member and said step of also heat sealing said horizontally extended upper packaging member to said horizontally extended lower packaging member transversely so as to create a separated compartment for said bristles are performed simultaneously.

17. The method of claim 14 wherein said teeth-cleaning agent is selected from a group consisting of non-foaming dentifrices, tooth polish, and non-foaming mouthwash.

18. The assembly of claim 14 wherein said teeth-cleaning agent and said moistening agent comprise at least one identical liquid medium and said liquid medium is selected from a group consisting of wintergreen flavored liquids, wintergreen scented liquids, peppermint flavored liquids, and peppermint scented liquids.

19. The method of claim 14 wherein said step of heat sealing perimeter edges of said horizontally extended upper packaging member to said horizontally extended lower packaging member creates packaging units for each of said toothbrushes and associated disposable towel packages that are only slightly longer than the length dimension of said toothbrush and only slightly wider than the width dimension of said associated disposable towel package.

20. The method of claim 14 wherein said step of creating said easily separable means in said horizontally extended upper packaging member and said horizontally extended lower packaging member separable attachment means is selected from a group consisting of perforated attachment means and ridged attachment means.

* * * * *